US006926438B2

(12) United States Patent
Girardin

(10) Patent No.: US 6,926,438 B2
(45) Date of Patent: Aug. 9, 2005

(54) CHRONOGRAPH MECHANISM

(75) Inventor: Johnny Girardin, Fritz-Courvoisier (CH)

(73) Assignee: Girard-Perregaux SA, La Chaux-de-Fonds (CH)

( * ) Notice: Subject to any disclaimer, the term of this patent is extended or adjusted under 35 U.S.C. 154(b) by 0 days.

(21) Appl. No.: 10/490,615

(22) PCT Filed: Sep. 6, 2002

(86) PCT No.: PCT/CH02/00487

§ 371 (c)(1),
(2), (4) Date: Jul. 13, 2004

(87) PCT Pub. No.: WO03/027778

PCT Pub. Date: Apr. 3, 2003

(65) Prior Publication Data

US 2004/0246820 A1 Dec. 9, 2004

(30) Foreign Application Priority Data

Sep. 24, 2001 (EP) ..... 01810930

(51) Int. Cl.[7] ..... G04F 8/00
(52) U.S. Cl. ..... 368/103; 368/110
(58) Field of Search ..... 368/101–106, 368/110, 1, 113

(56) References Cited

U.S. PATENT DOCUMENTS 3,739,570 A * 6/1973 Bachmann ..... 368/103
3,796,041 A * 3/1974 Boult ..... 368/103
3,901,020 A * 8/1975 Capt et al. ..... 368/105
5,793,708 A * 8/1998 Schmidt et al. ..... 368/106
6,428,201 B1 * 8/2002 Shibuya et al. ..... 368/106
6,761,478 B2 * 7/2004 Schmiedchen et al. ..... 368/101

FOREIGN PATENT DOCUMENTS

| | | | |
|---|---|---|---|
| CH | 228246 | 11/1943 | |
| DE | 19852347 | 5/2000 | ..... G04F/7/08 |
| EP | 1024416 | 8/2000 | ..... G04F/7/08 |
| GB | 2266791 | 11/1993 | ..... G04F/7/08 |

* cited by examiner

*Primary Examiner*—Vit W. Miska

(57) ABSTRACT

The invention concerns a chronograph mechanism of the type comprising a chronograph train (22) including:

Figure 1:
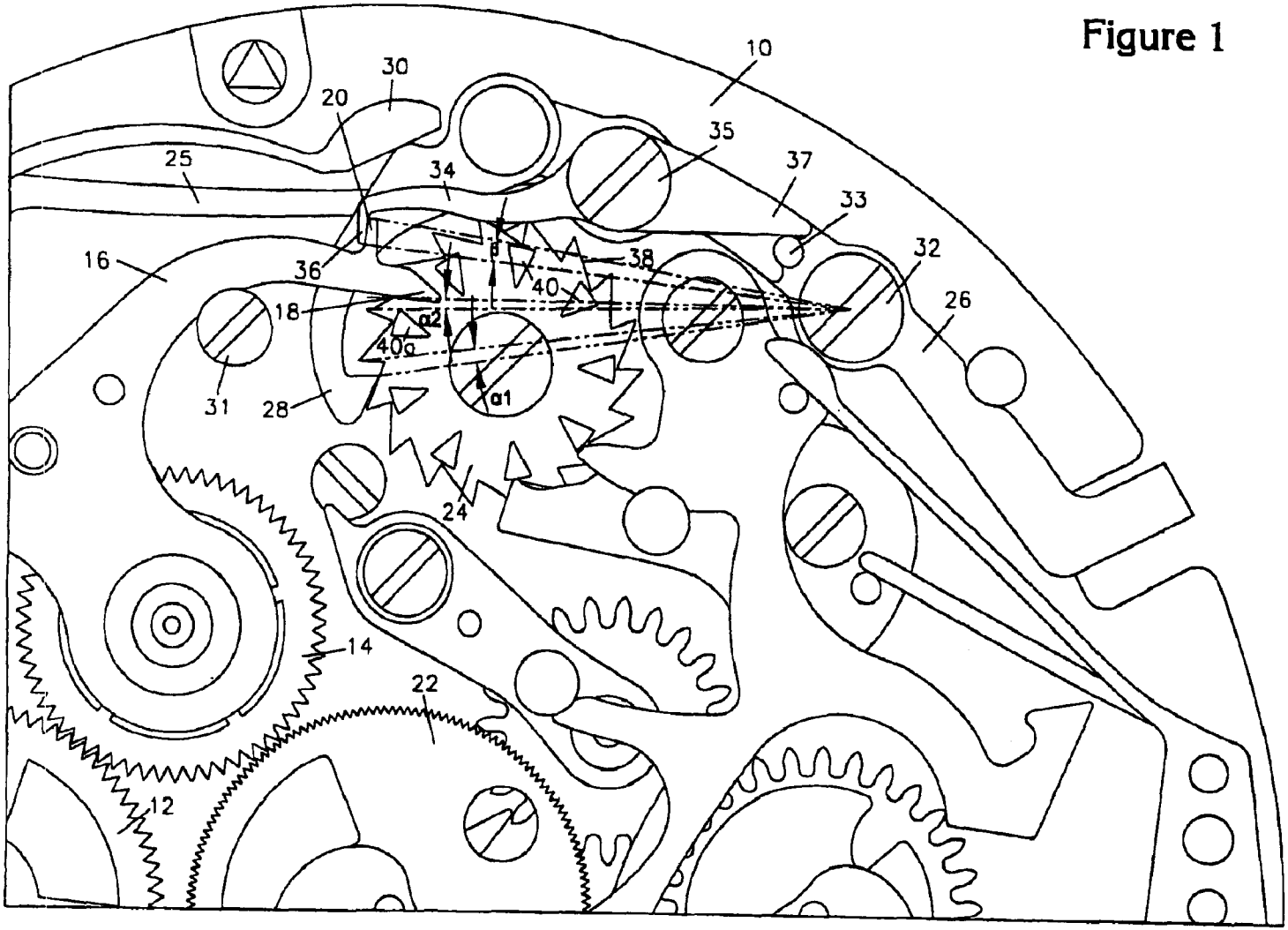

a coupling lever (16) for ensuring the movement of a coupling wheel, between a first position in which the mechanism is operating and a second position in which the mechanism is not operating, and a control lever (26) activating the coupling lever (16) to make it pass from one position to another.

In this mechanism, the control lever (26) carries a locking member (36) and the coupling lever (16) a catch (20) cooperating with the locking member when the coupling wheel (14) occupies its first position, such that the coupling lever (16) is prevented from moving via the effect of a shock when the chronograph is operating.

17 Claims, 2 Drawing Sheets

CHRONOGRAPH MECHANISM

The present invention relates to chronograph mechanisms, of the type comprising:

- a chronograph train for carrying at least one hand for the display of a measured time,
- a going train,
- a coupling wheel capable of occupying two positions and for connecting the chronograph train to the going train in one of such positions,
- a coupling lever fitted with a stop and for ensuring the movement of the coupling wheel, between its first position in which the mechanism is operating, and its second position in which the mechanism is not operating,
- a coupling member for ensuring the movement of the coupling wheel, between its first position in which the mechanism is operating, and its second position in which the mechanism is not operating,
- a cam for cooperating with the coupling member for defining the first and second positions of the coupling wheel,
- a control lever fitted with a control member activating the cam and, via said cam, the coupling member to make the wheel pass from one position to the other.

A mechanism of this type is, for example, disclosed in the book of horological theory by Chs-A. Reymondin et al., page 232 (Federation des Ecoles Techniques de Suisse, 1998, ISBN 2-940025-10-X). In this mechanism, the cam is a column wheel. The coupling member is a lever carrying a coupling wheel for kinematically connecting the going train of the watch, which rotates permanently, to the chronograph wheel, which only rotates on demand. More specifically, the coupling wheel is meshed or not meshed depending upon whether the lever occupies its first or its second position.

The end of the lever is fitted with a nose forming a stop and which, in cooperation with the columns of the column wheel, depending upon whether it is facing a gap or it is resting on a tooth of the column wheel, defines the first and second positions, via the effect of the lever spring.

Despite the support springs responsible for keeping the various members in place while they are operating, it can happen that, during a measurement, with the mechanism in its first position, a violent movement by the wearer or a violent shock causes the coupling lever to jump. The driving of the chronograph train is then interrupted for an instant, which falsifies the measurement. The present invention implements means for overcoming the drawback stated hereinbefore.

The mechanism is therefore characterized in that the control lever includes a locking member and the coupling member is fitted with a catch cooperating with the locking member when the coupling wheel occupies its first position, such that the lever is prevented from moving via the effect of a shock when the coupling wheel is meshed with the chronograph wheel.

Advantageously, the coupling member is a lever fitted with a stop cooperating with the cam, and the cam is a column wheel that includes:

- a Breguet toothing forming a ratchet-wheel, and
- columns arranged perpendicularly and concentrically to the toothing.

Moreover, the control member includes a hook secured to the control lever and a nose forming a stop arranged for respectively cooperating with the ratchet-wheel and with the columns of the column wheel.

In order to ensure optimal working conditions, the hook is arranged such that the locking member has released the catch before a column cooperates with the nose.

It is also advantageous, in the mechanism and in accordance with the invention, for the control lever, the ratchet-wheel, the locking member and the catch to be arranged such that, when the coupling wheel is in its first position, the control lever cooperates with the lever via the locking member which is abutting against the catch.

The chronograph mechanism according to the invention is further characterized in that the sum of the thickness of the locking member and of the catch is less than or equal to the length of the arc described by the end of the coupling lever between the positions that it occupies when the coupling wheel is in its first or second position.

Figure 2:
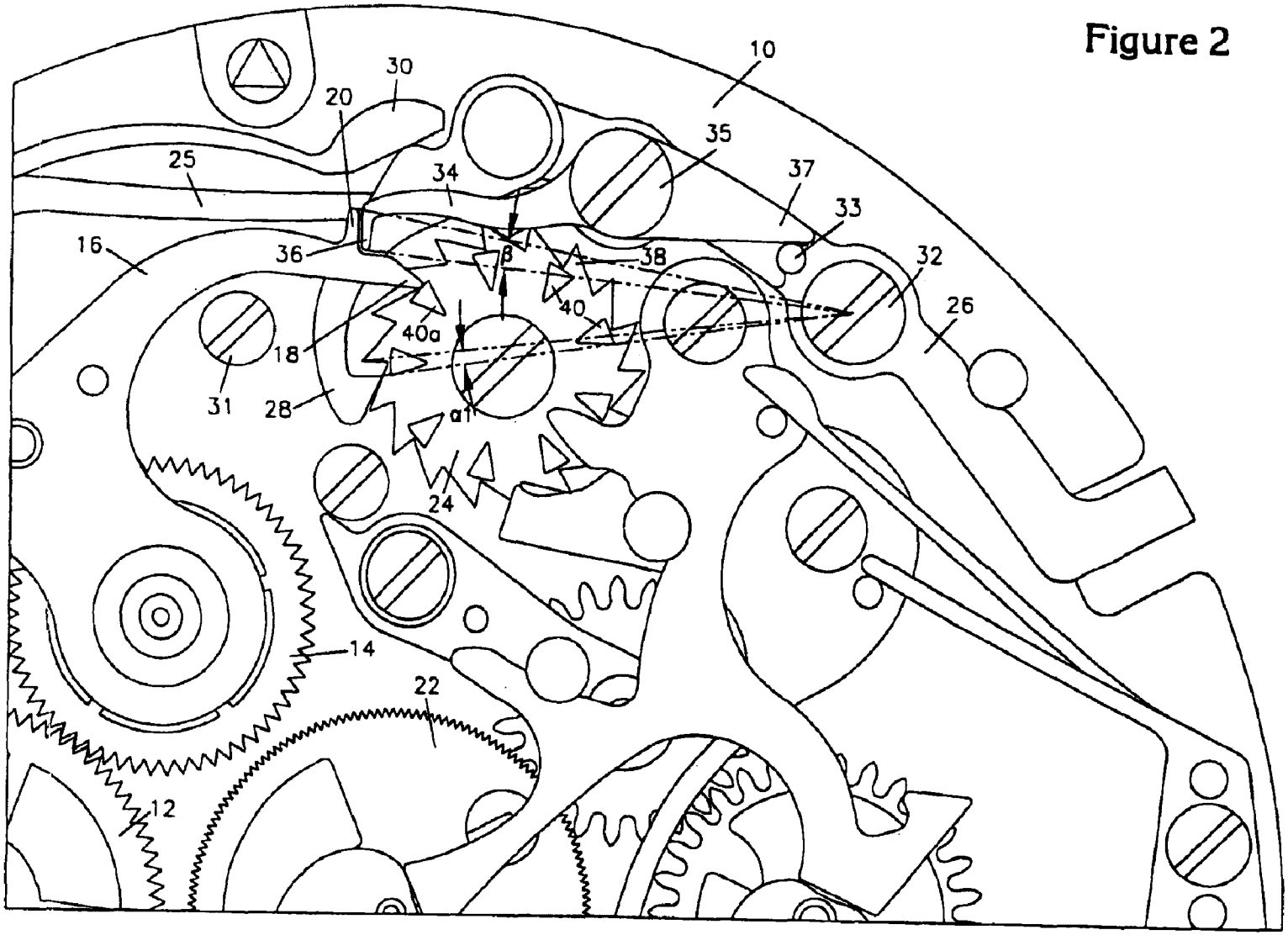

The invention will be better understood upon reading the following description, made with reference to the annexed drawings, in which FIGS. 1 and 2 are top views of a watch movement fitted with a chronograph mechanism, respectively in the coupled position and the uncoupled position.

The movement shown in the drawing includes a plate 10, which carries the essential elements of the chronograph mechanism, namely a coupling mechanism including:

- a chronograph drive wheel 12 secured in rotation to the second wheel set of the going train of the watch, which is situated on the side of plate 10 opposite that shown in the drawing,
- a coupling wheel 14 meshed with the drive wheel 12, and capable of occupying two positions,
- a coupling lever mounted so as to pivot on the plate, carrying the coupling wheel 14 and fitted, at one of its ends, with a nose 18 forming a stop and for defining the positions of the coupling wheel, and a catch 20 for locking lever 16, as will be explained hereinafter, and
- a chronograph wheel set 22 placed at the center of the movement and meshed or not meshed with the coupling wheel 14, depending upon whether wheel 14 occupies its first or second position, and a control device for the coupling device, which includes:

- a column wheel 24, cooperating with nose 18 of lever 16 in order to position it,
- a column wheel jumper spring 25 defining the stable positions of said column wheel,
- a control lever 26, mounted so as to pivot on the frame, controlled by a push-button that is not shown in the drawing and secured to the watchcase,
- a control hook 28 mounted so as to pivot on the control lever and arranged for cooperating with column wheel 24, as will be explained hereinafter,
- and a hook spring 30 secured to plate 10 and holding hook 28 pressed against column wheel 24, while ensuring the return of lever 26 to its rest position.

In this movement, the going train permanently rotates and sets coupling wheel 14 in action via drive wheel 12. Wheel 14 is meshed or not meshed with wheel set 22 depending upon whether it occupies its first or second position. Thus, when lever 16 occupies the position shown in FIG. 1, the chronograph is operating, whereas it is not operating in the position illustrated in FIG. 2.

Lever 16 pivots at its end opposite that including nose 18 on a cam secured to plate 10, not shown since it is outside the field of the drawing. Lever 16 is subjected to a positioning torque by a lever spring that is also arranged outside the field of the drawing. In the position shown in FIG. 1, it is abutting against a cam 31, nose 18 being engaged between two columns 40.

Control lever 26 pivots on a stud, and is held in place by a screw 32 fixed in a threaded hole in the stud. One of its ends carries control hook 28, mounted so as to pivot, whereas the other end is arranged, in a conventional manner, for cooperating with the control push-button. This possible pivoting of hook 28, combined with the pressure of hook spring 30, holds it in a position allowing it to cooperate with column wheel 24. Control lever 26 carries a pin 33.

According to an important feature of the invention, an arm 34 is fixed onto the upper face of control lever 26 by means of a screw 35 engaged in a hole made in its median portion. One of its ends is fitted with a locking member 36 arranged for cooperating with catch 20. The other end forms a stop 37, which is supported against pin 33. When the chronograph mechanism is being adjusted, screw 35 having been unscrewed, arm 34 is pressed by locking member 36 against catch 20 and by stop 37 against pin 33. The screw can then be tightened, the arm then being perfectly adjusted.

Column wheel 24 is manufactured in one piece and is made up of a Breguet toothing forming a ratchet-wheel 38 and columns 40 arranged perpendicularly and concentrically to the toothing, the angular pitch of the columns being double of that of the Breguet toothing. It is positioned by jumper spring 25 engaged on the Breguet toothing of ratchet-wheel 38. It manages the interaction between the control and coupling devices.

In the coupled position, as shown in FIG. 1, nose 18 of the lever is engaged in one of the spaces comprised between columns 40. Coupling wheel 14 is, thus, in its first position and drives chronograph wheel set 22. In this position, locking member 36 straddles catch 20. The length of arm 26, and the shape of catch 20 and of locking member 36 are selected such that arm 34 is supported on lever 16 via the flanks of catch 20 and locking member 36. Since arm 34 is secured to control lever 26, which is positioned by spring 30, locking member 36 and catch 20 are consequently in intimate contact with each other and lock lever 16 in its position where wheel 14 is meshed with wheel 22, even if a shock tends to move it.

Control hook 28 and ratchet-wheel 38, on the one hand, and nose 18 of coupling lever 16 and the space between two columns 40, on the other hand, do not coincide exactly, since the parts exhibit a play with respect to each other. More specifically, control lever 26 has to pivot by an angle $\alpha 1$ for hook 28 to travel the backlash existing between said hook and ratchet-wheel 38, then by an angle $\alpha 2$ for column wheel 24 to rotate until a column, identified by the letter a, enters into contact with nose 18. In order to ensure optimum working, lever 16 must only be set in motion after locking member 36 has released catch 20. This condition is fulfilled when the angle $\alpha=\alpha 1+\alpha 2$ is greater than $\beta$, the angle by which control lever 26 has to pivot for locking member 36 to release catch 20 totally. Moreover, the sum of the thickness of locking member 36 and of catch 20 has to be less than or equal to the arc described by nose 18 of coupling lever 16 between the positions that it occupies depending upon whether it is abutting against a column 40 or engaged in a space comprised between two columns 40.

The mechanism thus described operates in the following manner. An application of pressure on the push-button causes lever 26 to pivot clockwise and, with it, arm 34 and control hook 28. First of all, hook 28 takes up the play of the backlash, then it drives column wheel 24 until column 40*a* enters into contact with nose 18, lever 26 thus traveling through angle a. During this time, locking member 36, part of arm 34, is raised and moves away from catch 20, thus releasing the movement of coupling lever 16.

Secondly, column 40*a*, upon contact with nose 18, raises it, thus causing coupling lever 16 to pivot such that coupling wheel 14 is released from chronograph wheel set 22. Column 40*a* thus acts on nose 18 of coupling lever 16 to cause it to pivot in the space left free by locking member 36. When lever 26 has reached the end of its travel, i.e. when control hook 28 has driven column wheel 22 through one step of the Breguet toothing, column wheel 24 is in a position such that column 40*a* holds lever 16 so that wheel 14 is disengaged from wheel 22.

When the push-button is released, control lever 26 returns to its initial position via the effect of jumper spring 30, control hook 28 jumping onto one tooth of ratchet-wheel 38 whereas locking member 36 passes to the other side of catch 24. Nose 18 of the coupling lever remains abutting column 40*a*, defining the second position of coupling wheel 14 in which the chronograph wheel set is no longer being driven.

Another application of pressure onto the push-button causes lever 26 to pivot and, with it, locking member 36 and control hook 28. As in the movement previously described, the lever begins by taking up the play of the backlash, then drives column wheel 24 through one step of the Breguet toothing, such that nose 18 leaves the support of column 40*a* and falls into the space comprised between two columns. At that moment, lever 26 is in a position such that locking member 36 is situated outside the space traveled by catch 20. Coupling lever 16 can thus pivot freely until it encounters cam 31, nose 18 thus being again engaged between two columns 40.

When the push-button is released, control lever 26 returns to its initial position, as shown in FIG. 1, control hook 28 jumping one tooth of ratchet-wheel 38 as it moves back and locking member 36 straddling catch 20. Lever 22 has thus returned to its first position, in which coupling wheel 14 is meshed with coupling wheel set 22.

Thus a chronograph locking system is achieved which, via the cooperation of a locking member secured to the control lever and a catch disposed above the coupling lever, prevents lever 16 from inadvertently leaving its coupling position. Operating security is thus substantially improved.

The assembly that has just been described constitutes the control ensuring the coupling and uncoupling of the chronograph train. It is clear that this mechanism further includes means for resetting the chronograph train to zero, partially shown in the drawing, but which will not be described, since they are well known to those skilled in the art and without relevance to the present invention.

The scope of the invention is not limited to the particular case that has just been described. Those skilled in the art can evidently adapt the invention to other chronograph mechanisms, for example, with a cam of a different type from a column wheel or with an axial coupling.

What is claimed is:

1. Chronograph mechanism, of the type comprising:

a chronograph train (22) for carrying at least one hand for the display of a measured time, a going train, a coupling wheel (14) capable of occupying two positions and for connecting the chronograph train to the going train in one of such positions, a coupling member (16) for ensuring the movement of the coupling wheel, between its first position in which the mechanism is operating, and its second position in which the mechanism is not operating, a cam (24) for cooperating with the coupling member (16) for defining the first and second positions of the coupling wheel (14), a control lever (26) fitted with a control member (28) activating the cam (24) and, via said cam, the coupling member (16) to make the coupling wheel pass from one position to the other, characterized in that said lever (26) includes a locking member (36) and the coupling member (16) is fitted with a catch (20) cooperating with said locking member when the coupling wheel (14) occupies its first position, such that the coupling member (16) is prevented from moving via the effect of a shock when the coupling wheel is meshed with the chronograph train.

2. Mechanism according to claim 1, characterized in that said coupling member is formed of a lever (16) fitted with a stop (18) arranged so as to cooperate with said cam (22) for controlling the movement of the coupling wheel from one of said positions to the other.

3. Mechanism according to claim 2, characterized in that the cam (24) is a column wheel, which includes:

a Breguet toothing forming a ratchet-wheel (38) and columns (40) arranged perpendicularly and concentrically to the toothing, and in that said control member is a hook (28) cooperating with the ratchet-wheel (38).

4. Mechanism according to claim 2, characterized in that the stop is formed of a nose (18) arranged for cooperating with the columns (40) of the column wheel (24).

5. Mechanism according to claim 3, characterized in that the hook (28) is arranged such that a column (40) only cooperates with said nose (18) after the locking member (36) has released the catch (20).

6. Mechanism according to claim 2, characterized in that the control lever (26) and the coupling lever (16) are arranged such that, when said coupling wheel (22) is in its first position, the control lever (26) cooperates with the coupling lever (16) via the locking member (34), which abuts against the catch (24).

7. Mechanism according to claim 2, characterized in that the sum of the thickness of the locking member (36) and of the catch (24) is less than or equal to the length of the arc described by the end of the coupling lever (16) between the positions that it occupies when the coupling wheel is in its first or second position.

8. Mechanism according to claim 3, characterized in that the control lever (26) and the coupling lever (16) are arranged such that, when said coupling wheel (22) is in its first position, the control lever (26) cooperates with the coupling lever (16) via the locking member (34), which abuts against the catch (24).

9. Mechanism according to claim 4, characterized in that the control lever (26) and the coupling lever (16) are arranged such that, when said coupling wheel (22) is in its first position, the control lever (26) cooperates with the coupling lever (16) via the locking member (34), which abuts against the catch (24).

10. Mechanism according to claim 5, characterized in that the control lever (26) and the coupling lever (16) are arranged such that, when said coupling wheel (22) is in its first position, the control lever (26) cooperates with the coupling lever (16) via the locking member (34), which abuts against the catch (24).

11. Mechanism according to claim 3, characterized in that the sum of the thickness of the locking member (36) and of the catch (24) is less than or equal to the length of the arc described by the end of the coupling lever (16) between the positions that it occupies when the coupling wheel is in its first or second position.

12. Mechanism according to claim 4, characterized in that the sum of the thickness of the locking member (36) and of the catch (24) is less than or equal to the length of the arc described by the end of the coupling lever (16) between the positions that it occupies when the coupling wheel is in its first or second position.

13. Mechanism according to claim 5, characterized in that the sum of the thickness of the locking member (36) and of the catch (24) is less than or equal to the length of the arc described by the end of the coupling lever (16) between the positions that it occupies when the coupling wheel is in its first or second position.

14. Mechanism according to claim 6, characterized in that the sum of the thickness of the locking member (36) and of the catch (24) is less than or equal to the length of the arc described by the end of the coupling lever (16) between the positions that it occupies when the coupling wheel is in its first or second position.

15. Mechanism according to claim 8, characterized in that the sum of the thickness of the locking member (36) and of the catch (24) is less than or equal to the length of the arc described by the end of the coupling lever (16) between the positions that it occupies when the coupling wheel is in its first or second position.

16. Mechanism according to claim 9, characterized in that the sum of the thickness of the locking member (36) and of the catch (24) is less than or equal to the length of the arc described by the end of the coupling lever (16) between the positions that it occupies when the coupling wheel is in its first or second position.

17. Mechanism according to claim 10, characterized in that the sum of the thickness of the locking member (36) and of the catch (24) is less than or equal to the length of the arc described by the end of the coupling lever (16) between the positions that it occupies when the coupling wheel is in its first or second position.

* * * * *